US005815171A

United States Patent [19]

Brugue

[11] Patent Number: 5,815,171

[45] Date of Patent: Sep. 29, 1998

[54] SLIDING ASSEMBLY FOR PLOTTERS AND METHOD FOR ADJUSTMENT OF SPACING BETWEEN THE PRINTING HEAD AND THE PRINTING MEDIA

[75] Inventor: Joaquim Brugue, Barcelona, Spain

[73] Assignee: Hewlett-Packard Company, Palo Alto, Calif.

[21] Appl. No.: 559,911

[22] Filed: Nov. 17, 1995

[30] Foreign Application Priority Data

Nov. 25, 1994 [EP] European Pat. Off. ..... 94500196

[51] Int. Cl.[6] ..... B41J 23/00; B41J 11/20; B41J 11/22

[52] U.S. Cl. ..... 347/8; 347/37; 400/355; 400/55

[58] Field of Search ..... 347/8, 37; 400/355, 400/55, 56, 57, 58, 59

[56] References Cited

U.S. PATENT DOCUMENTS

| | | | |
|---|---|---|---|
| 4,990,004 | 2/1991 | Kawahara et al. | 400/56 |
| 5,087,141 | 2/1992 | Kelly | 400/59 |
| 5,227,809 | 7/1993 | Carpenter | 400/59 |
| 5,576,744 | 11/1996 | Nikura et al. | 347/8 |
| 5,608,439 | 3/1997 | Jones et al. | 400/59 |
| 5,610,636 | 3/1997 | Hanabusa et al. | 400/59 |

FOREIGN PATENT DOCUMENTS

| | | |
|---|---|---|
| 194844A3 | 9/1986 | European Pat. Off. . |
| 360728A1 | 3/1990 | European Pat. Off. . |
| 434327A3 | 6/1991 | European Pat. Off. . |
| 479270A1 | 4/1992 | European Pat. Off. . |
| 434327A2 | 6/1992 | European Pat. Off. . |
| 2045689 | 11/1980 | United Kingdom . |

OTHER PUBLICATIONS

Patent Abstracts of Japan—vol. 12, No. 374 (M–794)—Oct. 6, 1988—Mitsubishi Electric Corp.

European Search Report—EP 94 50 0196—dtd. 29 Apr. 1995.

*Primary Examiner*—Adolf Berhane
*Assistant Examiner*—Bao Q. Vu

[57] ABSTRACT

Improvement are described in the sliding assembly of a plotter and for a method for the adjustment of the spacing between a printing head and the printing media. The improvements consist in that the sliding assembly which comprises the movable carriage and the printing head is mounted on a main sliding guide parallel to the printing media with simultaneous lengthwise sliding capacity on said main sliding guide as well as being pivotable thereabout, until an adjustment value of the spacing between the printing head and the printing media is obtained. An abutment limits the pivot distance of the sliding assembly. The abutment is comprised of a second guide that is parallel to the main sliding guide The sliding assembly comprises two units connected by means of an articulated joint, the mutual position of both units being adjustable as to the angle or rotation.

16 Claims, 4 Drawing Sheets

SLIDING ASSEMBLY FOR PLOTTERS AND METHOD FOR ADJUSTMENT OF SPACING BETWEEN THE PRINTING HEAD AND THE PRINTING MEDIA

FIELD OF THE INVENTION

This invention relates to improvements in sliding assemblies for plotters and similar apparatus, and a method for adjustment of the spacing between the printing head and the printing media in such plotters.

BACKGROUND OF THE INVENTION

Usually, in plotters and similar machines, a sliding assembly is provided that slides along a guide which is parallel to the printing media upon which graphic impressions are to be printed. The sliding assembly supports a printing head which prints on the media, usually by means of the projection of jets of ink, ink bubbles or other methods. A problem affecting the performance of plotters and other apparatus of similar type is the maintenance of a controlled spacing between the outlets of the printer's ink jet nozzles and the printing media which receives the ink. When the spacing between the outlets of the nozzles and the printing media is smaller than a predetermined spacing or exceeds same, the printing is liable to show faults. In case of a too large spacing, the ink jet will be too wide at the moment of impinging on the printing media and the printed marks will be too big and the edges fuzzy. When the spacing is too small, the ink will not spread properly on the printing media, its drying will be slower and smearing is liable to occur.

The way to usually attack such problems is by prescribing tight tolerances for the parts forming the sliding assembly as well as its corresponding guiding and driving means, in order that the positioning of the printing head with respect of the printing media meets predetermined spacing value tolerances. However, this process requires the machining of parts of the sliding assembly with very close tolerances, resulting in a high cost of manufacture. Such a solution is less than satisfactory because the additive part tolerances render it difficult to maintain a well controlled spacing between the outlets of the ink nozzles and the printing media.

Some attempts have been made to try to adjust the spacing between the printing head and the printing media. U.S. Pat. No. 5,087,141 to C. B. Kelly, issued on Feb. 11, 1992, discloses a system comprising an intermediate bar or roller contacting the printing paper, performing a pinching action on the drive roller, while the carriage bearing the printing head and the intermediate bar has a pivoting movement. This arrangement is capable of relating the position of the printing head to the printing media, regardless of the thickness of the latter. The system is aimed at permitting the apparatus to operate with different thicknesses of printing media, but it is not aimed nor has the means to adjust the actual value of the spacing between the printing head and the printing media, as in the present invention.

To find a solution to the above problem, which is common to the ink jet printing systems known heretofore, this invention has as an objective to provide new means and a corresponding method for the adjustment of the spacing between the outlets of the ink nozzles and the printing media. The objective is that spacing be kept within a desired tolerance range, substantially regardless of the tolerances of the individual parts, thereby allowing their manufacture at a lower cost.

Another objective of this invention is to enable a narrower tolerance range for the spacing between the outlet of the ink nozzles and printing media.

Another additional objective of this invention consists in providing means and a method for the determination and adjustment of the spacing between ink nozzle outlets and the printing media, while requiring a lesser number of parts than in the prior art.

Another objective of the present invention is to assure that once the adjustment of the spacing between the outlets of the nozzles for the ink and the printing media has been made, that the spacing exhibits remarkable stability during the service life of the apparatus.

Another objective is to provide a means for adjustment of the spacing between the printing head and the printing media, such adjustment being carried out easily and in a short time.

SUMMARY OF THE INVENTION

To achieve these objectives, the present invention provides a sliding assembly, which comprises a movable carriage and a printing head with nozzles for the injection of ink. The apparatus comprises two interconnected units, so that the following conditions are met:

a) the sliding assembly engages a main guide which determines the path of the printing head, and has the capacity for not only lengthwise sliding but also for pivoting on said main guide until the desired adjustment position of the printing head, in relation to the printing media, is obtained. The extent of the pivoting is determined by abutment means which limit the pivoting of said sliding assembly;

b) the abutment means which limit the pivoting of the sliding assembly comprises a second straight guide parallel to the main guide, said second straight guide being contacted by an abutment portion of the sliding assembly;

c) the two units forming the sliding assembly are interconnected to each other by means of an articulation joint, adjustable in rotation and capable of being blocked in a position which determines a variable pivoting position between both units;

d) one of the units of the sliding assembly is guided on the main sliding guide while the second unit engages the second straight guide by means of an abutment portion;

e) the sliding assembly has means for the variation of the pivoting position of both units of the sliding assembly on an articulation joint, which means may be rigidly blocked in the desired position;

f) the center of gravity of the sliding assembly is offset with respect to the main guide, lying on the side of the assembly corresponding to the printing head, whereby the printing head has a tendency to swivel towards the printing media; and g) both the main straight guide as well as the second abutment guide are machined on the same one piece support frame.

By this arrangement, the invention permits the sliding of the assembly under the guidance of both the main straight guide and the second abutment guide which limits the pivoting of the assembly. The pivoting of the assembly is stable during the operation of the machine because of the offset arrangement of the gravity center as explained under e). This effect may be enhanced by pre-loading springs.

At the same time, it is possible to adjust the correct spacing between the outlets of the ink nozzles and the printing media in an adjustment step carried out after the final assembly of the plotter. At such time, the relative rotation of both units forming the sliding assembly on the shaft of its articulated joint is adjusted until the precise height or spacing between the outlets of the injection nozzle and the printing media is obtained. Then, the relative position between both units are rigidly blocked to permit the correct spacing to be maintained so that the separation between the outlets of the injection nozzles and the printing media is maintained, substantially regardless of the tolerances of the individual parts. At the same time, given the rigid blocking of the relative position between both units forming the sliding assembly, said spacing will be practically maintained constant during the service life of the machine or, alternatively, until a new value is chosen for said height or adjustment of the printing head to the printing media. The new adjustment may be carried out in a simple and fast way by unblocking, adjusting and blocking again the articulated joint. Alternatively, the blocking effect may be obtained by action of an adjustment screw.

Therefore, the adjustment method which forms part of the present invention will be characterized in that, in an arrangement as provided by the present invention, the following operation steps will be carried out:

i) Measuring the actual spacing between the outlets of the ink nozzles and the printing media by means of any suitable type of measurement device;

ii) Causing relative rotation of both units forming the sliding assembly on the rotation shaft of the articulated joint, until a predetermined spacing between the outlets of the ink nozzles and the printing media is obtained; and iii) Locking both units of the sliding assembly to each other, thus canceling the capacity for relative rotation to one another on the shaft of the articulated joint.

The step i) may be carried out by any suitable measurement means, for example by external fixed gauges, for instance balls, or by means of measuring devices with optic distance detection means or other non-contact distance detecting means to be attached to a portion associated to the printing head in order to accurately gauge said spacing. The measuring means will be preferably associated with an optical display means to show the actual value of the spacing. Said measurement operation will eventually enable the accurate determination of the spacing in different positions of the sliding assembly along the main guide, with the aim to evaluate the eventual differences along the path of the sliding assembly allowing, whenever desired, an averaging of said measurements. The relative rotation of the two units forming the sliding assembly and its locking together after the adjustment of the spacing are be carried out by any suitable means without essentially affecting this invention. Preferably, said relative rotation will be carried out by a simple system comprising a screw and fixed nut together with a bias spring. The rigid locking of the parts may be carried out by means of adhesive or a solidifiable mass, for instance a wax or resin material, whereby after its solidification, the constant position between both units may be easily maintained.

BRIEF DESCRIPTION OF THE DRAWINGS

For a better understanding, a non limiting preferred embodiment of the invention will be explained in the following with reference to the attached drawings, in which.

DETAILED DESCRIPTION OF THE INVENTION

Figure 1:
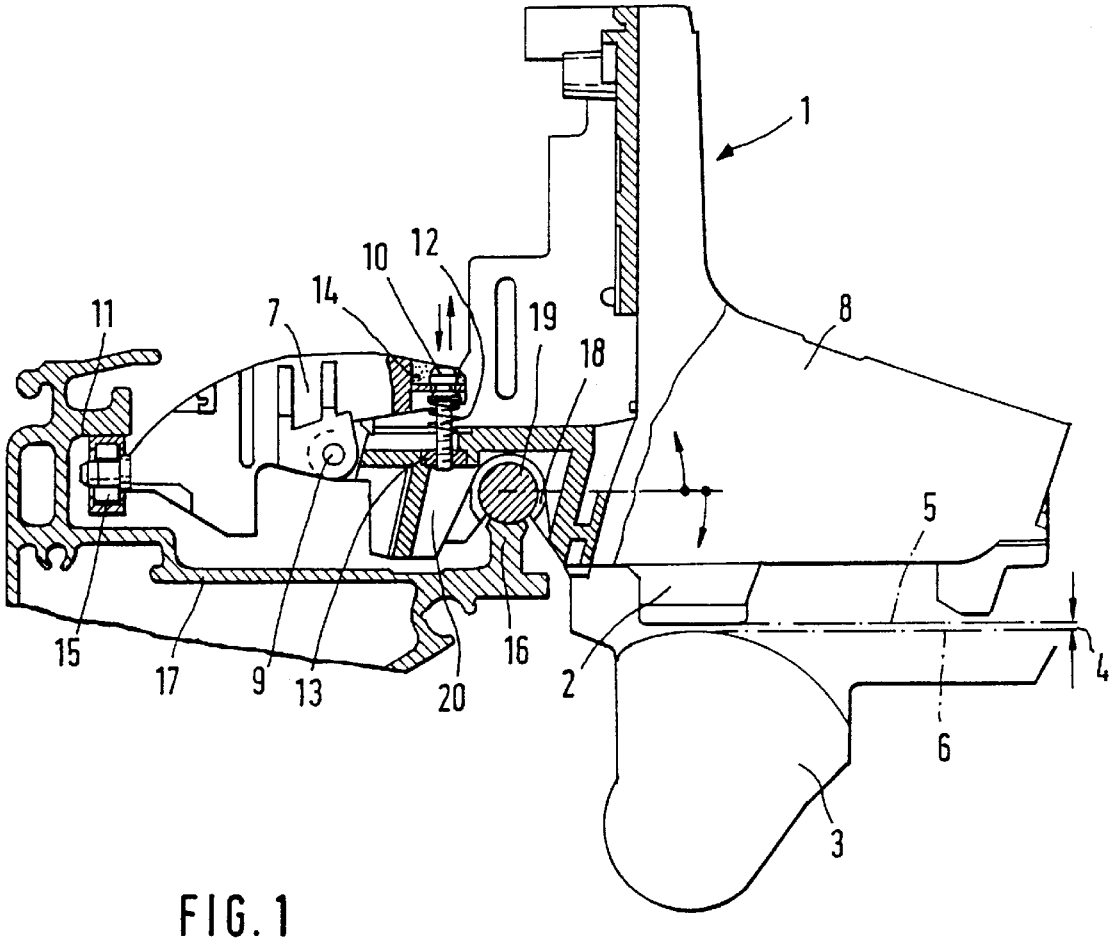
FIG. 1 shows schematically a cross section of the sliding assembly carrying the printing head of a plotter, according to the present invention.

This invention encompasses a means to allow the movement of the sliding assembly -1- of a plotter or similar apparatus, and comprises a printing means or printing head schematically shown by reference numeral -2-, said printing means being aimed at producing graphic marks on printing media that is guided by a drum or similar part -3- of the apparatus. For a better understanding, the drawing does not show the media to receive the printing nor the driving and guidance means for the same, which are conventional.

The main objective of the present invention consists in permitting an easy adjustment of the spacing between the printing media and the printing head, that is, between the outlets of the injection nozzles and the printing media, permitting at the same time that said spacing may be maintained during the operation of the apparatus. Said spacing has been indicated with the reference numeral -4-, consisting in the spacing between the dot and dash lines -5- and -6- which, respectively, represent the lower edge of the ink injection nozzles and the media to receive the graphic marks.

These improvements provide that the sliding assembly -1-, which has been represented perpendicular to the plane of the drawing, in order to carry out the printing on the printing media on the drum -3- at a level shown by dot/dash line -6-, comprises two units -7- and -8- interconnected by means of an articulated joint with a rotating shaft shown by reference numeral -9-. The improvement includes means for permitting the variation of the rotation position between units -7- and -8- by means of pivoting on the shaft -9-, said means being represented as an example in FIG. 3, by an adjustable screw -10-, which will be explained in more detail below.

The sliding assembly -1-, comprising the two units -7- and -8-, is movable along a path which is parallel to the printing support by engagement with a main straight guide -19-, along which it may slide by operation of driving means which have not been represented, with a further capacity to pivot on said main guide. To limit the pivoting of the sliding assembly on the main guide, a second guide -11- is provided parallel to said main guide -19-, on which second guide a portion of the body -7- abuts when the sliding assembly pivots on the main guide, limiting the angle of rotation of said assembly -1-.

As will be easily understood, the pivoting of assembly -1- will determine the spacing or height -4- of the printing head to the printing media -6-. The adjustment of said spacing -4- in a final step of assembly of the apparatus, substantially regardless of the individual tolerances of manufacture of the parts, is enabled by adjustment of the two units -7-, -8- with respect to each other on rotation shaft -9-, further enabling the pivot angle of assembly -1- to be accurately adjusted to have a predetermined spacing -4-.

Figure 3:
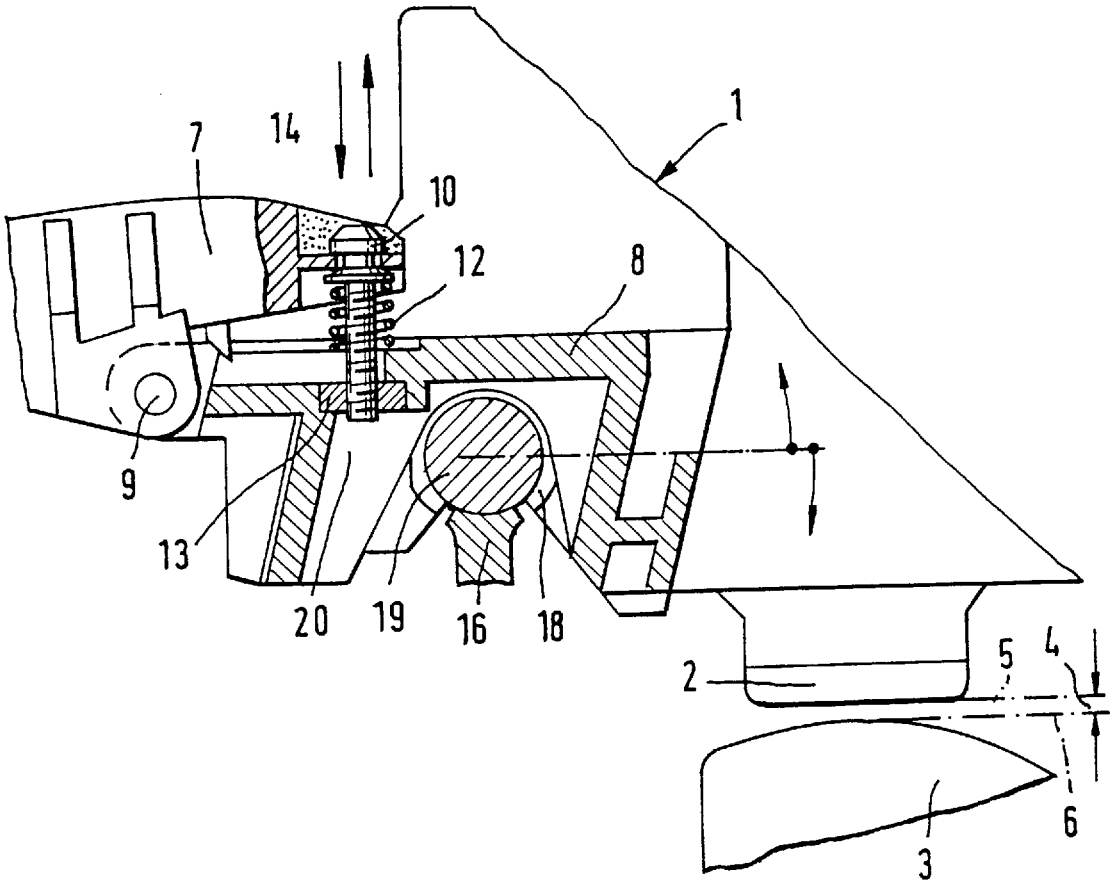
FIG. 3 shows a detail in cross section of the articulation of the two units forming the sliding assembly.
Figure 4:
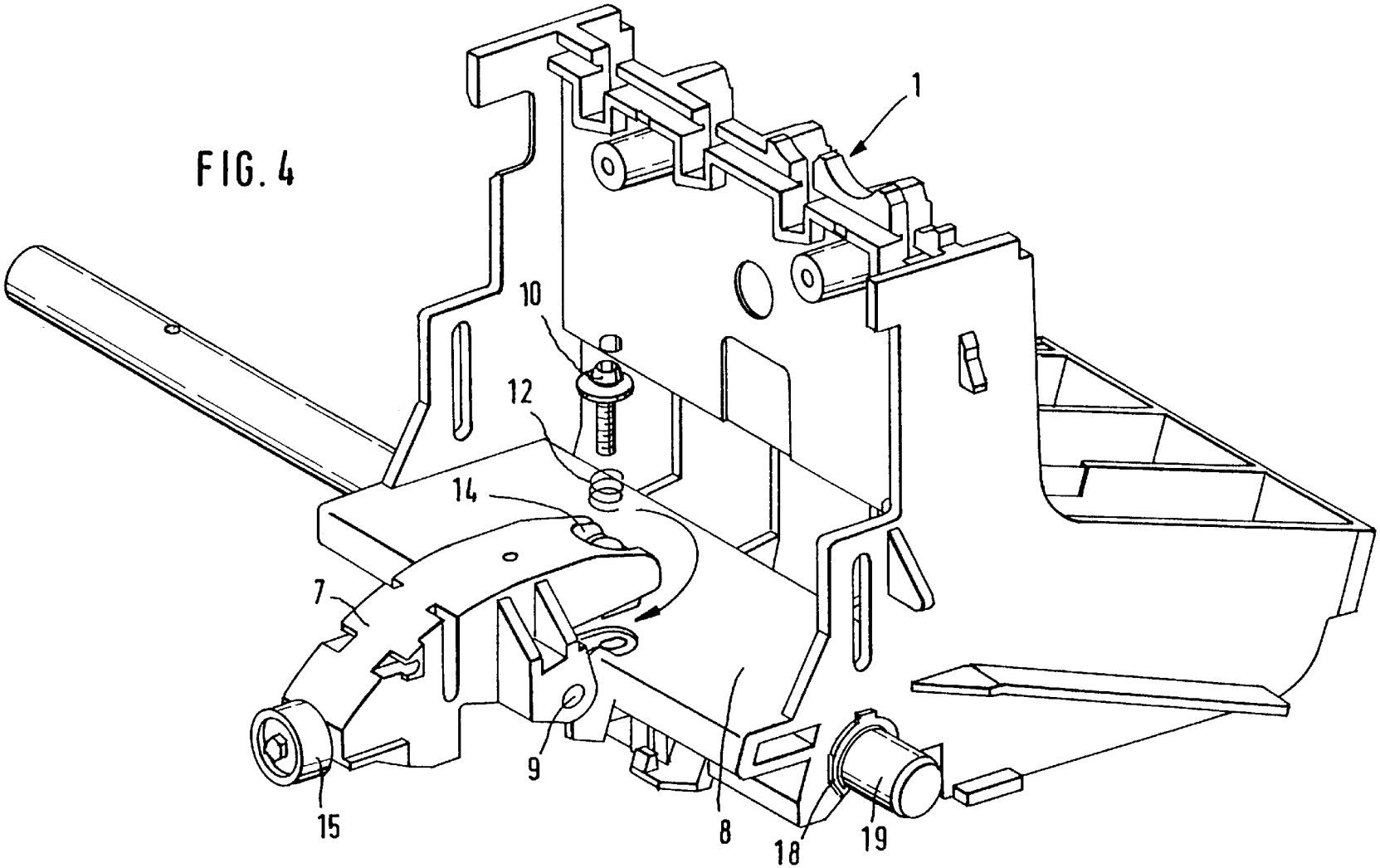
FIG. 4 shows a perspective view of the sliding assembly of FIGS. 1 and 2.

To make the relative rotation between units -7- and -8- of the sliding assembly -1- easier, the invention provides, as an example, an adjustment mechanism comprising a screw -10- which, as shown in FIG. 3, is under bias of a spring -12- which further engages a fixed nut -13- or similar fixed threaded portion. In this way, by turning the screw -10- clockwise or counter-clockwise, collaborating with the action of spring -12-, it is possible to adjust the relative positions of units -7- and -8-(which constitute the sliding assembly -1-).

After having obtained a predetermined relative position of rotation of units -7- and -8- which determine, in turn, the desired spacing -4-, further rotation of the screw -10- may be prevented, if desired, by any suitable positive means, thus avoiding further inadvertent adjustment of spacing -4-. Among the methods which may be used for said locking action, is a fluid solidifiable mass to be poured within the cavity -14- for the head of the screw -10- or between the screw and its nut, for instance, a wax or resin which, after solidification, will prevent an unintentioned rotation of the screw -10-.

As will be easily understood, in case of wishing to change the spacing -4- according to eventual changes in the set up of the apparatus, it is sufficient to eliminate the locking means and reproduce the above mentioned adjustment process. The blocking of the screw -10- may be obtained as well by limiting travel of the tip of said screw on the unit -8-, for instance, by wall -20-.

According to the present invention, the main guide will preferably comprise a circular cross section precision machined bar -19-, resting on a wall -16- of the body -17- of the apparatus, preferably obtained by light alloy extrusion, said body comprising as well a secondary guide -11-. Any other type of suitable straight guide could be used provided that permits the guidance of the assembly -1- parallel to the printing media -6- and that at the same time permits the pivoting of said assembly -1- around a horizontal center line to permit the adjustment of the above mentioned printing spacing.

Likewise, the guide -11- will comprise, preferably, a flat straight guide as shown in the figures, preferably machined together with the wall -16- (or its support) to obtain satisfactory parallelism. Said guide will be engaged by one or more rollers -15- mounted on a portion of unit -7-. These rollers might be substituted by friction bushings or similar.

Figure 2:
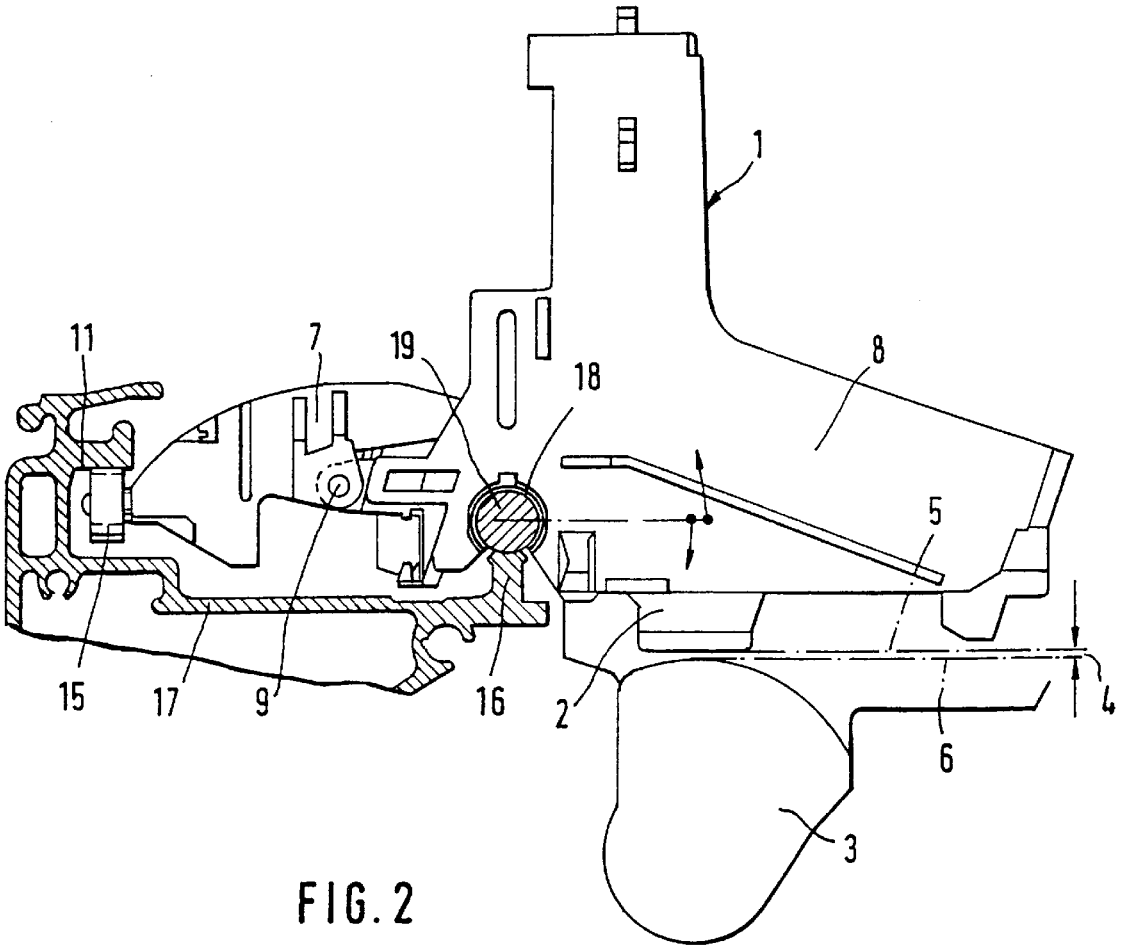
FIG. 2 shows a view similar to FIG. 1 along a parallel section plane.

The sliding assembly -1- may be incorporated on the main guide -19- according to any suitable arrangement which permits its displacement along the guide and its simultaneous pivoting on the same. In FIG. 2, an embodiment is shown with partly encircling bushings -18- or a similar arrangement in the lower part of the sliding assembly to permit the arrangement of the assembly -1- centered and guided on the bar -19-, permitting its rotation without interfering with the upper rims of supporting wall -16-. To improve the stability of the sliding assembly -1- in relation to the main guide, these improvements provide that the center of gravity of the assembly is offset in relation to said main guide, displaced towards the printing head, that is, opposed to the second abutment guide -11-, whereby the assembly -1- will have a tendency by its own weight to adopt a stable position corresponding to the pivoting arrangement chosen to make the spacing -4- to correspond with the desired value. To further improve the stability of the sliding assembly -1-, abutting against guide -11-, pre-loading springs can be incorporated to exert a certain pressure on said guide -11-.

As will be easily understood, an apparatus incorporating the improvements of this invention, having the means which have been explained in the foregoing, will entail a process for the adjustment of the spacing of height of the printing unit characterized by the following steps:

i) measuring the actual spacing -4- between the outlet of the ink nozzles and the drum -3- which supports the printing media, by means of any suitable type of measurement device;

ii) enabling relative rotation of both units -7- and -8-, which form sliding assembly -1-, on rotation shaft -9- of an articulated joint, to obtain a predetermined spacing -4- between the outlets of the ink nozzles and the printing media; and iii) optionally proceeding to rigidly lock both units -7- and -8- of the sliding assembly -1-, canceling the capacity for relative rotation to one another on shaft -9- of the articulated joint.

The step i) may be carried out by means of external fixed gauges, for instance by means of balls or incorporating a sensing pen in the printing head, capable to directly indicate the actual value of the spacing or height -4-, by means of a dial or a visual display.

The step ii) will be carried out according to one preferred embodiment of this invention, in the form which has been shown in the figures, by simple rotation in the desired sense of screw -10- which operates together with the fixed nut or similar threaded portion -13- and the spring -12-.

If desired, the step iii) will be carried out, for instance, by means of the introduction of a solidifiable mass in the cavity -14- receiving the head of the screw -10- or by limiting travel of the screw or by any other suitable means.

This invention has been explained according to a preferred embodiment of the same, as shown by the enclosed drawings.

However, it will be understood that the details of said embodiment are not limitative for the invention and that any expert in the art will be able to introduce many variations in the invention which will be included within the scope of the enclosed claims.

What is claimed is:

1. A sliding assembly for a plotter which enables adjustment of spacing between a printing head and printing media, said sliding assembly comprising:

a main sliding guide oriented parallel to said printing media;

a movable carriage, including said printing head, positioned on said main sliding guide by mounting means, said mounting means enabling simultaneous lengthwise sliding of said carriage on said main sliding guide and pivoting of said carriage with respect to said main sliding guide, said carriage comprising first and second units connected by articulated joint means which enables mutual positions of said first and second units to be angularly adjusted with respect to each other, said articulated joint means including pivot adjustment means for obtaining a desired adjustment value of angle between said first and second units and, as a result, an adjustment of spacing between said printing head and said printing media; and abutment means for limiting the pivoting of said carriage by interaction with said first unit.

2. The sliding assembly according to claim 1, wherein said abutment means comprises:

a second sliding guide positioned parallel to the main sliding guide and including an abutment portion which interacts with said second unit.

3. The sliding assembly according to claim 1, further comprising means for locking said articulated joint means in an angular position to retain a desired angle between said first and second units.

4. A sliding assembly according to claim 3, wherein said first unit is guided on said main sliding guide, while said second unit abuts the second sliding guide by means of an abutment portion.

5. A sliding assembly according to claim 4, wherein the abutment portion is comprised of rollers mounted on said second unit.

6. A sliding assembly according to claim 4, wherein the abutment portion is comprised of friction bushings mounted on said second unit.

7. A sliding assembly according to claim 1, wherein said sliding assembly has a center of gravity offset in respect of said main sliding guide, towards a side which includes the printing head.

8. A sliding assembly according to claim 1, wherein said main sliding guide comprises a precision circular cross section bar which is supported by a wall of said plotter.

9. A sliding assembly according claim 8, wherein both the wall which receives said circular cross section bar as well as the second sliding guide comprises a machined one-piece supporting frame of the plotter.

10. A sliding assembly according claim 1, wherein said pivot adjustment means comprises an adjustment screw mounted on one said unit and biased away from another said unit by a bias spring that engages a fixed nut or fixed threaded portion.

11. A method for the adjustment of spacing between a printing head and printing media of a plotter, which incorporates a main sliding guide oriented parallel to said printing media, a movable carriage, including said printing head, positioned on said main sliding guide by mounting means, said mounting means enabling simultaneous lengthwise sliding of said carriage on said main sliding guide and a pivoting of first and second units of said carriage with respect to said main sliding guide, said carriage including pivot adjustment means between said first and second units for obtaining a desired adjustment value of spacing between said printing head and said printing media, and abutment means for limiting the pivoting of said carriage, said method comprising the steps of:

i) measuring spacing between ink outlets of said printing head and a drum supporting the printing media;

ii) rotating said first and second units about a rotation shaft comprising said articulated joint until a predetermined spacing is achieved between said ink outlets and the printing media; and iii) locking said first and second units so as to prevent further relative rotation therebetween about said shaft of the articulated joint.

12. The method according to claim 11, wherein said measuring step is carried out by means of gauge means incorporated into the printing head which further provides an indication of a value of said spacing.

13. The method according to claim 11, wherein said locking step is carried out by injection of a fluid solidifiable mass about a screw which comprises a portion of said pivot adjustment means.

14. The method according to claim 11, wherein said locking step is carried out by means of a screw, which comprises a portion of said pivot adjustment means, said screw engaging a portion of the carriage.

15. A sliding assembly according to claim 1, wherein the printing head and abutment means are located on opposite sides of the main sliding guide.

16. A sliding assembly according to claim 1, wherein said pivot adjustment means obtains said desired adjustment value by adjustment through a substantially continuous sequence of values between first and second predetermined adjustment values.

* * * * *